United States Patent [19]

Winchell

[11] 4,282,980

[45] Aug. 11, 1981

[54] PLASTIC HANGER FOR CONTAINERS

[75] Inventor: David A. Winchell, Twin Lakes, Wis.

[73] Assignee: Baxter Travenol Laboratories, Inc., Deerfield, Ill.

[21] Appl. No.: 157,778

[22] Filed: Jun. 9, 1980

Related U.S. Application Data

[63] Continuation of Ser. No. 25,261, Mar. 29, 1979, abandoned.

[51] Int. Cl.[3] ..... B65D 23/00

[52] U.S. Cl. ..... 215/100 A; 248/318; 248/359

[58] Field of Search ..... 215/100 A, 100 R; 222/181; 248/359, 311.3, 317, 318

[56] References Cited

U.S. PATENT DOCUMENTS

| | | | |
|---|---|---|---|
| 2,304,547 | 12/1942 | Cutter | 248/359 |
| 2,635,604 | 4/1953 | Fredrickson | 215/100 A X |
| 3,215,299 | 11/1965 | Coanda et al. | 215/100 A |
| 3,387,732 | 6/1968 | Jellies | 215/100 A |
| 3,581,928 | 10/1968 | Amand | 215/100 A |
| 3,620,875 | 11/1971 | Guglielmo | 156/272 |
| 3,744,658 | 7/1973 | Fujio | 215/100 A |
| 3,901,399 | 8/1975 | McPhee | 215/100 A |
| 4,010,862 | 3/1977 | Gilbert | 215/100 A |
| 4,013,187 | 3/1977 | Betka | 215/100 A |

*Primary Examiner*—Donald F. Norton

*Attorney, Agent, or Firm*—Paul C. Flattery; John P. Kirby, Jr.; Gary W. McFarron

[57] ABSTRACT

A plastic hanger for medical containers or the like is described which, in its normal, unstressed position, lies adjacent the bottom of the container so as not to interfere with setting the container on a flat surface. The hanger is molded separately from the container and sealed or attached to a rib formed on the bottom of the container.

13 Claims, 4 Drawing Figures

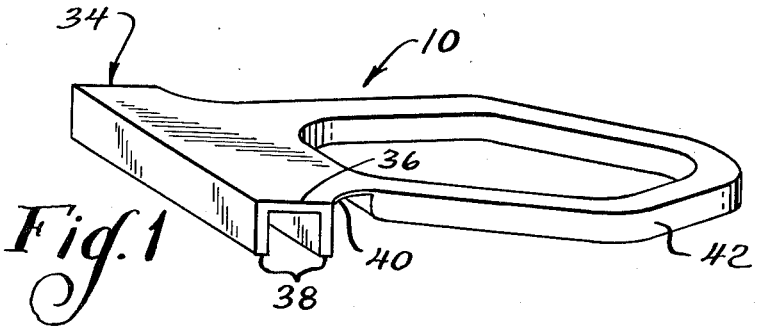
Fig. 1
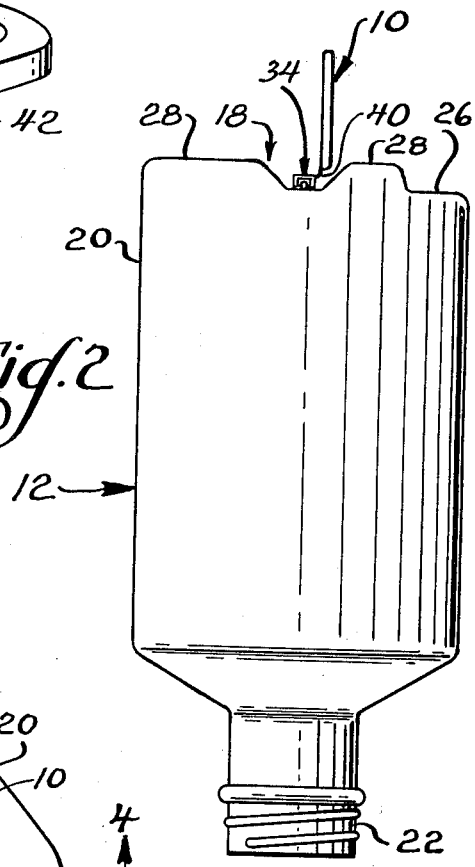
Fig. 2
Fig. 3
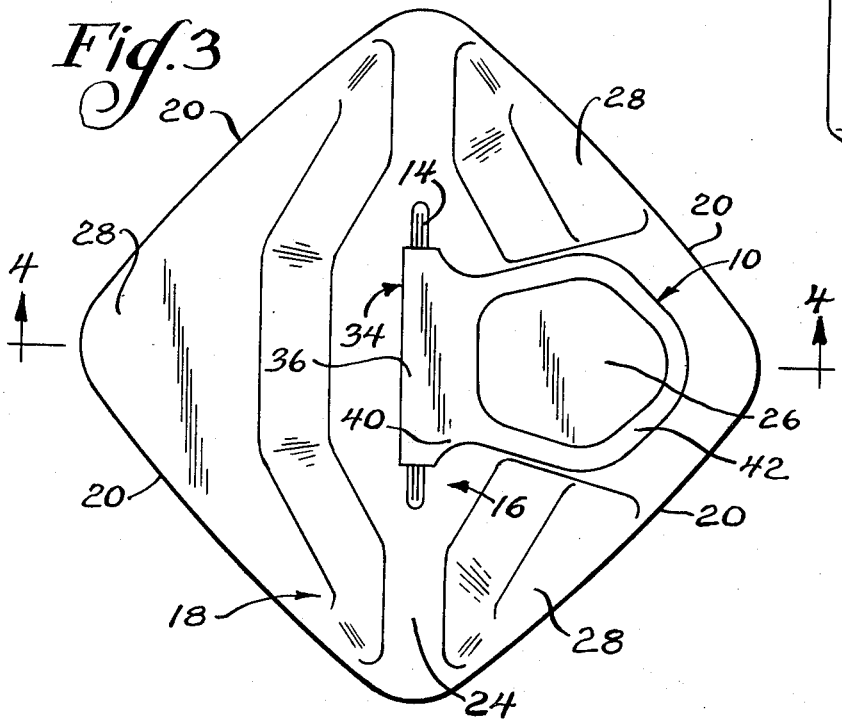
Fig. 4
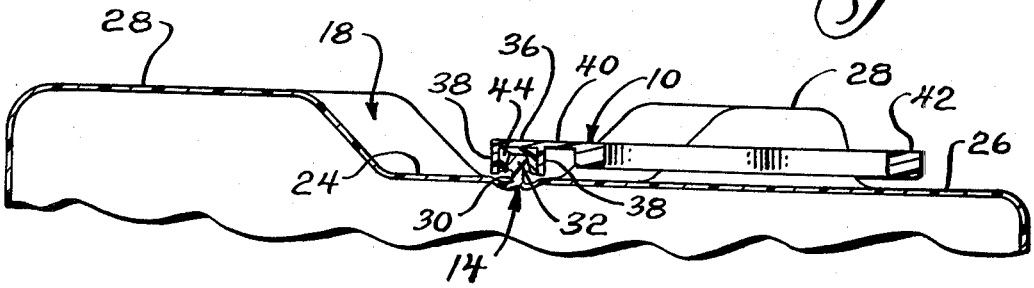

PLASTIC HANGER FOR CONTAINERS

This is a continuation of application Ser. No. 25,261, filed 3/29/79, now abandoned.

The present invention generally relates to medical containers and hangers for them. More particularly it relates to plastic hangers for attachment to the bottom of medical containers, which do not interfere with resting the container on a flat surface.

Hangers have long been used with medical containers and the like for hanging the container in an inverted position for gravitational discharge of the fluid within the container. With plastic containers, the hanger often has been integrally molded in the bottom of the container, as illustrated in U.S. Pat. Nos. 3,215,299 and 3,387,732.

It is also known to provide a hanger separately, which is snapped onto a rib formed along the bottom of the container. U.S. Pat. No. 4,013,187 is typical of this type of hanger. That patent shows a hanger with a C-shaped bar which slips over a matching T-shaped rib on the bottom of the container.

The one-piece hanger-container combination is relatively difficult to mold and increases the empty bottle cost. This is particularly true in regard to oriented plastic containers, where the nature of the process and material makes formation of a one-piece hanger-container especially difficult. On the other hand, when a hanger is provided separately and attached to an underlying rib, as shown in the U.S. Pat. No. 4,013,187, there is a risk that the hanger will unsnap or release when the container is hung vertically. This is, of course, a greater problem with larger and heavier containers.

Whether the hanger is molded as one piece with the container or slid over a depending rib on the bottom, it is desirable that, until the container is needed, the hanger not interfere with resting the container on a flat surface, for example, a countertop or the like. In some existing container-hanger products, the hanger is folded into a recess in the container bottom and held there by snap-around lugs in the bottom. The lugs are usually formed by undercutting a portion of the bottom wall of the container. U.S. Pat. No. 4,010,862 shows a typical container using undercut portions in the bottom, into which the hanger is folded. However, the undercuts are also difficult to mold, and typically result in large quantities of waste product in addition to requiring slower manufacturing operations.

U.S. Pat. No. 3,215,299 discloses another technique for securing the hanger in a recessed space in the container. There, the hanger and container are molded as one piece. The hanger is bent into a recessed space and the container is heated, e.g., during sterilization, to form a "set" in the hanger which supposedly retains it in the bottom recess. As noted before, one-piece hanger-container combinations are difficult to mold generally, and are impractical for oriented plastic containers.

Accordingly, it is an object of the present invention to provide a hanger and container which does not suffer from the deficiencies described above.

It is another object of the present invention to provide a container with a hanger which does not interfere with resting the container on a flat surface and does not require lugs molded into the bottom or a separate heat-setting step for holding the hanger in a lay-down position against the bottom of the container.

It is yet another object of the present invention to provide a bottle with a hanger that is separately molded but firmly attachable to the bottom of the container and does not suffer the risk of accidental disengagement.

These and other objects of the present invention are set forth in the following specification and the attached drawings of which:

FIG. 1 is a perspective view of the hanger embodying the present invention.

FIG. 2 is an elevational view of a container and hanger embodying the present invention, with the hanger in the position for hanging the container in an inverted position.

FIG. 3 is a plan view of the bottom of the container of FIG. 2 with the hanger in its normal, unstressed position adjacent the bottom of the container.

FIG. 4 is a cross-sectional view taken along line 4—4 of FIG. 3.

The present invention is generally embodied in a plastic hanger 10 for attachment to the bottom of a plastic medical liquid container, such as a pour bottle 12, for hanging the bottle in an inverted position. The bottom of the bottle includes support means in the form of an upstanding rib 14 in a recessed portion 16 of the bottle bottom. The hanger 10 is attached to the rib and, when not in use, resides in the recessed portion so as not to interfere with resting the container on a flat surface, such as a countertop or bedside table. In accordance with the present invention, the plastic hanger 10 is molded separately from the container 12, in a configuration so that when attached to the bottle bottom rib 14 the hanger lies naturally, in its unstressed position, within the recessed portion 16 of the bottle bottom, without the need for gripping lugs or undercut portions in the bottle.

The container 12 in the illustrated embodiment is a plastic, blow-molded pour bottle, typically filled with sterile water, saline solution or the like. Although a variety of materials may be satisfactory, this container is preferably made of polypropylene, and manufactured employing a technique which orients the plastic longitudinally and circumferentially, resulting in improved strength and clarity. The container includes a bottom wall, generally at 18, and four sidewalls 20, terminating in a threaded neck portion 22, through which the contents may be dispensed when the container is inverted.

The bottom wall 18 is recessed at 16 to mount the hanger 10 and to provide a space in which the hanger may reside without interfering when the bottle is set on a flat surface. As best seen in FIG. 3, the recessed surface has an elongated portion 24, that extends between opposite corners of the container and in which the bottle rib 14 is located. Perpendicular to this is a diverging, hanger-receiving recess 26. This construction divides the bottom of the container into several raised surfaces 28 upon which the container rests.

For hanging the container 12 in an inverted position, the hanger 10 is secured to the rib 14 upstanding from the bottom of the container in the elongated portion 24 of the recess 16. During the blow molding of the container 12, the rib 14 is integrally formed between the molds of the blow molding apparatus. The shape of the rib, of course, depends on the molds used. In the preferred embodiment, the rib is generally T-shaped, with an upstanding stem 30 and an enlarged head 32 upon the stem.

The hanger 10 itself, as noted earlier, is molded separately from the bottle 12. Although the hanger may be formed in any of a variety of ways, e.g., extrusion, it is preferably injection molded, using any of a variety of thermoplastic materials that are sufficiently strong to support a relatively large, 2–4 liter, container filled with liquid. The preferred material for the hanger is the same as that for the bottle, polypropylene.

The hanger 10 is of integral, one-piece construction. It has an elongated bar 34 at one end for attachment to the rib 14 on the bottle bottom. The bar is preferably an inverted U-shaped channel with a top wall or plate 36 and a pair of sidewalls 38 depending perpendicularly from the top wall.

A relatively thin, flat hinge 40, which supports the bottle, extends the full length of the inverted channel. Referring to FIGS. 1 and 3, the hinge, as molded, extends at a right angle from the upper corner of the inverted channel, so as to be co-planar with the top wall 36. The free end of the hinge 40 terminates in a continuous hanging loop 42 as shown in FIG. 2. In the as-molded, unstressed position, the loop extends, via the hinge 40, directly outwardly from the sidewall 38 of the channel, in a plane parallel to the hinge and the top wall 36. Thus, when the channel is mounted over the rib 14 on the bottle bottom, the hanging loop 42 naturally lies within the hanger-receiving recess 26, substantially parallel to and closely adjacent the bottle bottom. Thus, the hanger is normally out of the way, and does not interfere with resting the container on a flat surface, and no undercuts or lugs are needed to keep it in that position.

Although the hinge 40 preferably extends from the hanger bar 34 as described above, it could also be constructed, e.g., to extend from the sidewall 38 at a position other than at the top corner of the channel, or to extend from the top wall and have a molded angle which causes the hanging loop 42 to lie within the bottom recess 26 in the hanger's unstressed position.

The hanger 10 may be attached to the rib 14 in a variety of ways. For example, the sidewalls 38 of the channel may have inturned portions which slide or snap under the T-shaped rib. However, a more secure and desirable attachment involves sealing or bonding the bar to the rib. In the preferred embodiment, the U-shaped, inverted channel is positioned over the rib and heat sealed to it. Although ultrasonics or other heat sealing techniques may work, in the illustrated embodiment, a strip of plastic material 44 impregnated with ferromagnetic particles is placed between the top of the T-shaped rib and the top wall 36 of the hanger channel. The bottle and hanger are passed through an electromagnetic field, which by induction heating, heats the strip, causing portions of the strip, and adjacent portions of the channel and the rib to melt. The melted portions coalesce to fuse and seal the bottle, strip and hanger together. As the strip 44 melts, part of it may also flow between the sidewalls 38 and the rib, including beneath the overhang of the T-shaped rib, to help strengthen the seal between the hanger and rib. A more detailed explanation of such a technique for attaching the hanger may be found in U.S. Pat. No. 3,620,875.

With the hanger and bottle construction shown above, the hanger 10 normally, in its unstressed position, resides in a hanger-receiving recess in the bottom of the container. No lugs or undercuts are required in the bottle to hold the hanger loop within the recess. When the bottle needs to be hung in the inverted position, the loop is merely raised from the recess, with the hinge bending to a stressed position as shown in FIG. 2. Moreover, the hanger is preferably heat sealed to the bottle rib to form an integral attachment that does suffer from the risk of accidental detachment.

The present invention has been described in terms of the preferred embodiment for the purposes of illustration and not limitation. It is intended that the present application as defined in the following claims, also cover those equivalent structures, some of which may be apparent upon reading this description and others of which may become apparent only after some study.

What is claimed is:

1. A one-piece thermoplastic hanger comprising an inverted U-shaped channel including a top wall and a pair of depending sidewalls, a thin hinge extending at a right angle from one of said sidewalls along the upper edge thereof, and being co-planar with said top wall, and a loop attached to said hinge, the plane of said loop being substantially co-planar to the plane of said hinge and said top wall when said hinge is in its natural, unstressed position.

2. A plastic bottle comprising:

a bottom wall adapted to rest on flat surfaces, recessed portions within said bottom wall, a rib integral with said bottom wall and located in one of said recessed portions, a separate hanger attached to the bottom of said bottle for hanging the bottle in an inverted position, said hanger comprising an inverted, U-shaped channel having a top wall and a pair of depending sidewalls, said channel overlying at least a portion of said rib, plastic material impregnated with ferromagnetic particles between said rib and said channel and bonding them rigidly together, said hanger further comprising a thin hinge extending from one of said sidewalls of said channel, said hinge being substantially co-planar with said top wall of said channel, said hinge terminating in a hanger loop residing, in an unstressed portion, in one of said recessed portions of said bottle bottom.

3. A plastic hanger for mounting to a bottle with a recessed bottom wall and support means adjacent said recessed bottom wall, said hanger comprising:

a bar for attachment to said support means;

a hanger loop for hanging the bottle;

a relatively thin hinge connecting said bar and loop, said hinge being disposed in its normal, unstressed position so that when said bar is attached to said support means, said hanger naturally resides in said bottle recess; and said bar comprising an elongated plate portion for securing to the top of a T-shaped rib of said support means and said hinge extending from a lateral edge of said plate portion.

4. A plastic hanger for mounting to a bottle with a recessed bottom wall and support means adjacent said recessed bottom wall, said hanger comprising:

a bar for attachment to said support means;

said bar comprising an inverted channel including a top wall and a pair of side walls for covering and attaching over an elongated rib of said support means;

a hanger loop for hanging over the bottle;

a relatively thin hinge connecting said bar and said loop, said hinge being disposed in its normal, unstressed position so that when said bar is attached to said support means, said hanger naturally resides in said bottle recess; and said hinge extends from the side of said inverted channel.

5. A hanger in accordance with claim 4 wherein said hinge is substantially flat in the unstressed state and the hinge, the top wall, and the loop lie in the same horizontal plane.

6. A hanger in accordance with claim 4 wherein said channel is U-shaped for ease of fitting over the top of the elongated rib of the support means.

7. A plastic container comprising a bottom wall adapted to rest on a flat surface, a rib integral with said bottom wall and a separate hanger for hanging said container in an inverted position, said hanger comprising a bar secured to said rib, a loop for hanging the container and a relatively thin hinge extending between and integrally joining said bar and said loop, said bar including a plate portion which overlies said rib, said hinge extending from a lateral edge of said plate portion and being disposed in the unstressed state to support said loop adjacent the bottom of said container to reduce interference when the container is set on a flat surface.

8. A plastic container comprising a bottom wall adapted to rest on a flat surface, a rib integral with said bottom wall and a separate hanger for hanging said container in an inverted position, said hanger comprising a bar secured to said rib, a loop for hanging the container and a relatively thin hinge extending between and integrally joining said bar and said loop, said bar comprising an inverted channel including a top wall and a pair of sidewalls for fitting over said rib, said hinge extending normally from the side of said channel and being disposed in the unstressed state to support said loop adjacent the bottom of said container to reduce interference when the container is set on a flat surface.

9. A container in accordance with claim 8 wherein said hinge is substantially flat and the hinge, the top wall and the loop lie in the same horizontal plane.

10. A plastic container comprising a bottom wall adapted to rest on a flat surface, a rib integral with said bottom wall and a separate hanger for hanging said container in an inverted position, said hanger comprising a bar heat bonded to said rib, a loop for hanging the container and a relatively thin hinge extending between and integrally joining said bar and said loop, said hinge being disposed in the unstressed state to support said loop adjacent the bottom of said container to reduce interference when the container is set on a flat surface.

11. A container in accordance with claim 10 further comprising plastic material impregnated with ferromagnetic particles between said rib and said hanger bar.

12. A plastic container comprising a bottom wall adapted to rest on a flat surface, a substantially T-shaped rib integral with said bottom wall, and a separate hanger for hanging said container in an inverted position, said hanger comprising a bar for attachment to said T-shaped rig, a loop for hanging the container and a relatively thin hinge extending between and integrally joining said bar and said loop, said hinge being disposed in the unstressed state to support said loop adjacent the bottom of said container to reduce interference when the container is set on a flat surface, said hanger bar having a top wall portion and being secured to said T-shaped rib by a strip of plastic material impregnated with ferromagnetic particles which strip is disposed at least between said top wall and the top of said rib.

13. A container in accordance with claim 12 wherein said bar further includes a pair of sidewalls depending from the top wall and covering the side of said T-shaped rib, said strip of plastic material further providing a bond between said sidewalls and said T-shaped rib.

* * * * *